US005622232A

United States Patent [19]

Whisenhunt

[11] Patent Number: 5,622,232

[45] Date of Patent: Apr. 22, 1997

[54] BLASTHOLE DRILL WITH DRILL-THROUGH PIPE RACK

[75] Inventor: H. Dewain Whisenhunt, Oak Creek, Wis.

[73] Assignee: Harnischfeger Corporation, Brookfield, Wis.

[21] Appl. No.: 270,959

[22] Filed: Jul. 5, 1994

Related U.S. Application Data

[63] Continuation-in-part of Ser. No. 270,154, Jul. 1, 1994, abandoned.

[51] Int. Cl.[6] ..... E21B 19/14

[52] U.S. Cl. ..... 175/85; 175/52; 414/745.2

[58] Field of Search ..... 175/52, 85, 161, 175/162, 203, 220; 414/741, 745.2

[56] References Cited

U.S. PATENT DOCUMENTS

| | | | |
|---|---|---|---|
| 3,762,578 | 10/1973 | Cooper et al. | 175/85 X |
| 3,860,126 | 1/1975 | Neimark et al. | 214/2.5 |
| 3,896,887 | 7/1975 | Council | 173/43 |
| 3,920,087 | 11/1975 | Hisey et al. | 175/85 X |
| 4,049,064 | 9/1977 | Chubb et al. | 173/147 |
| 4,128,135 | 12/1978 | Mitchhart et al. | 175/52 |
| 4,595,066 | 6/1986 | Nelmark et al. | 175/85 |
| 4,708,581 | 11/1987 | Adair | 175/85 X |

*Primary Examiner*—Frank Tsay
*Attorney, Agent, or Firm*—Michael, Best & Friedrich

[57] ABSTRACT

A blasthole drill comprising a frame supported for movement over the ground, a mast supported by the frame for movement relative thereto between a substantially vertical position and a non-vertical position, the mast defining a drill hole axis, a drill-through pipe rack mounted on the mast, the pipe rack including a rack member, a gate mounted on the rack member, the gate having open and closed modes and being adapted to support the lower end of a drill pipe when the gate is in the closed mode, the gate permitting the drill pipe to move downwardly relative to the gate when the gate switches to the open mode, and the gate allowing movement of the rack member away from a drill pipe previously supported by the gate when the gate is in the open mode, a mechanism for moving the rack member horizontally relative to the mast and between an extended position wherein a drill pipe supported by the gate is on the drill hole axis and a retracted position wherein the gate is spaced from a drill pipe on the drill hole axis, and a rotary head moveable relative to the mast along the drill hole axis, the rotary head being selectively engageable with the upper end of a drill pipe supported by the pipe rack when the rack member is in the extended position.

17 Claims, 5 Drawing Sheets

Fig. 2.
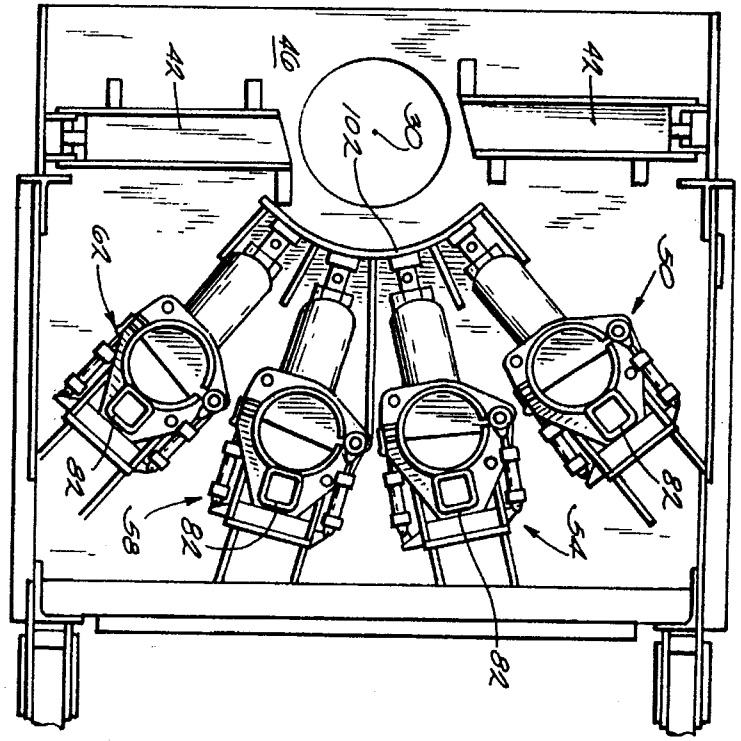
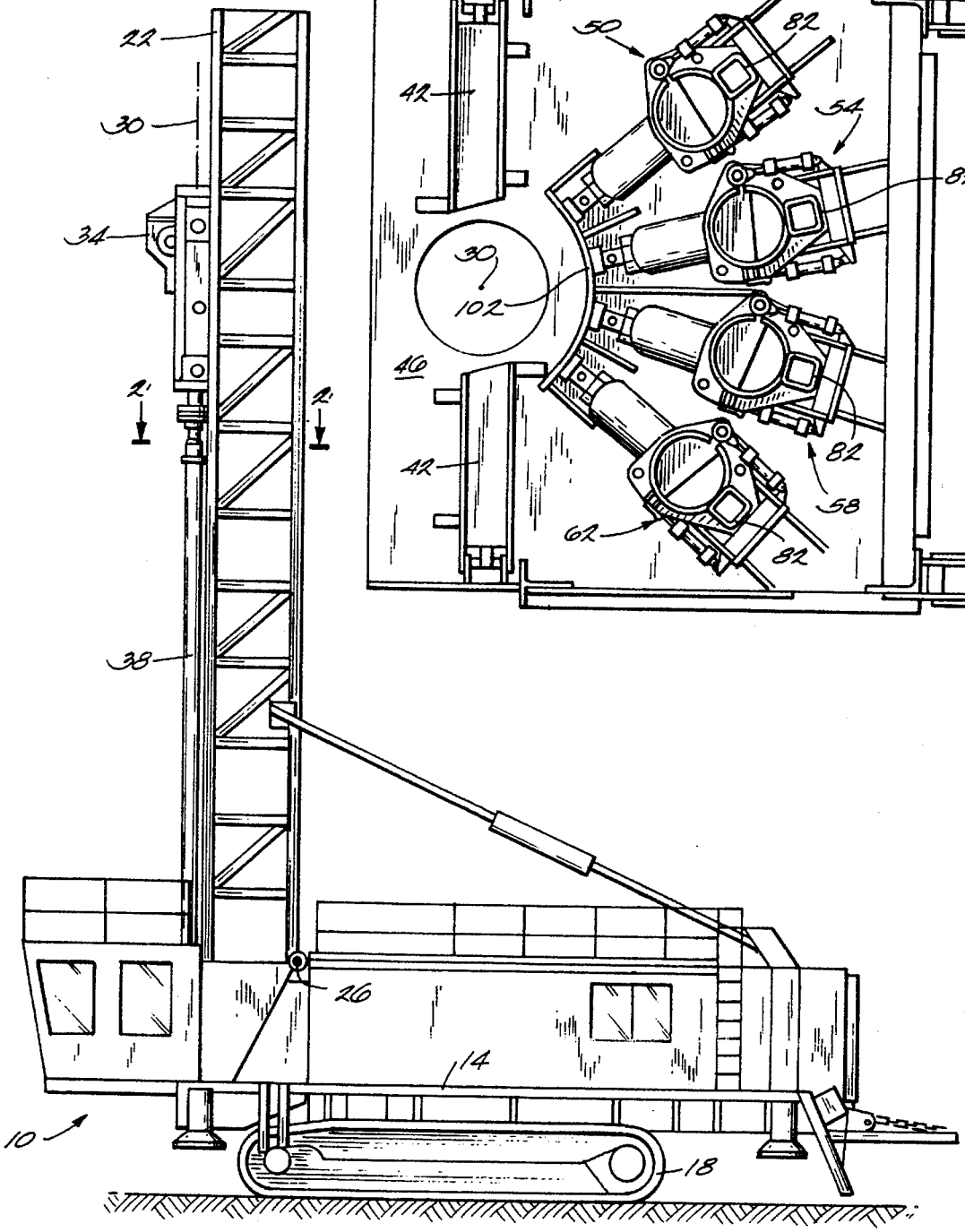
Fig. 1

90
54
70
86
66
38
22
164
82
110
94
106
74
78
102
30
98
46

90
38
86
66
164
82
70
22
110
94

74
54
78
22
98
46

BLASTHOLE DRILL WITH DRILL-THROUGH PIPE RACK

RELATED APPLICATION

This is a continuation-in-part of my Ser. No. 08/270,154, filed Jul. 1, 1994, and titled "Blasthole Drill with Drill-through Pipe Rack", which is now abandoned.

BACKGROUND OF THE INVENTION

Blasthole drills are large machines used in mining operations to drill holes for explosives. A conventional blasthole drill comprises a frame supported by crawlers for movement over the ground, and a mast supported by the frame for movement between a substantially vertical position and a number of angled or non-vertical positions. The mast defines a drill hole axis. A rotary head moves relative to the mast along the drill hole axis. The rotary head engages the upper end of a drill pipe for rotating the drill pipe and driving the drill pipe into the ground. When drilling a blasthole that is deeper than the height of the mast, more than one section of drill pipe must be used. After the first section of drill pipe is driven into the ground, the rotary head moves back to the top of the mast and another section of drill pipe is connected to the top of the first section. The rotary pipe then drives the second section into the ground. It is not unusual to use four sections of drill pipe. Such a deep blasthole is referred to as a "multi-pass" blasthole. The various sections of drill pipe are supported relative to the mast and moved into position (on the drill hole axis) at the appropriate time by a device known as a pipe rack.

When drilling a multi-pass blasthole, a considerable amount of time is spent in adding and removing individual drill pipe sections from the drill string. Also, when drilling blastholes at an angle, a considerable amount of time is spent engaging and disengaging a device known as a pipe positioner, which aligns and supports the lower end of a suspended pipe section (i.e., maintains the lower end of the pipe section on the drill hole axis) during connection and removal from the lower pipe string. Thus, a considerable amount of time is spent doing things other than drilling.

A carousel-type drill-through pipe rack is known. The carousel rack includes a circular plate which rotates about its center and which supports the lower ends of a plurality of drill pipes. The carousel must be extended to locate a pipe on the drill hole axis and must be retracted to allow the rotary head to pass.

SUMMARY OF THE INVENTION

The invention provides a drill-through pipe rack that increases production in drilling vertical or angled multi-pass holes. The bottom of the pipe rack supports and stores drill pipe when the pipe is not in use. After the rack positions a pipe section on the drill hole axis, the pipe rack remains open to allow the drill pipe to pass through in order to add or remove pipe sections without having to retract the pipe rack to its stored position as with conventional designs. The pipe rack requires less mast depth (i.e., less room) than known carousel-type pipe racks. Also, the pipe rack of the invention does not have to be retracted as fast (in order to allow the rotary head to pass) as the known carousel-type rack.

More particularly, the pipe rack of the invention includes an upper arm with an inner end connected to the mast for pivotal movement about a horizontal axis. The pipe rack also includes a lower arm with an inner end connected to the mast for pivotal movement about a horizontal axis. An elongated rack member has an upper end connected to the outer end of the upper arm for pivotal movement about a horizontal axis, and a lower end connected to the outer end of the lower arm for pivotal movement about a horizontal axis. The mast, the upper and lower arms and the vertical rack member define a parallelogram structure. The upper and lower arms are pivotable relative to the mast between generally vertical and generally horizontal positions. When the upper and lower arms are in their vertical positions, the rack member is in a storage or retracted position within the mast and away from the drill hole axis. When the upper and lower arms are pivoted to their horizontal positions, the rack member moves horizontally and downwardly to an extended position adjacent the drill hole axis. When the rack member is in its extended position, the lower arm is supported by a support mounted on the mast bottom plate. The support prevents over extending the hydraulic cylinder and also supports the rack when breaking the top joint from the rotary head using rotary machine torque.

The pipe rack also includes upper and lower gates which are mounted on the rack member and which support a drill pipe for movement with the rack member. When the rack member is in its extended position, a drill pipe supported by the gates is located on the drill hole axis. The gates are selectively opened and closed by hydraulics. The lower gate includes a shelf which supports the lower end of a drill pipe when the gate is closed. When the gate is opened, the shelf moves out from beneath the drill pipe such that the drill pipe can move downwardly relative to the gate.

The drill-through pipe rack reduces drill pipe addition cycle time because the pipe rack does not have to be returned to its stored position before the drill pipe begins downward movement. Also, a lower drill pipe positioner is not required because the lower gate maintains the position of the drill pipe during initial downward movement. Furthermore, drill productivity is increased through shorter cycle time.

Other features and advantages of the invention will become apparent to those skilled in the art upon review of the following detailed description, claims and drawings.

DESCRIPTION OF THE DRAWINGS

FIG. 1 is a side elevational view of a blasthole drill embodying the invention.

FIG. 2 ms a view taken generally along line 2—2 in FIG. 1.

Figure 3:
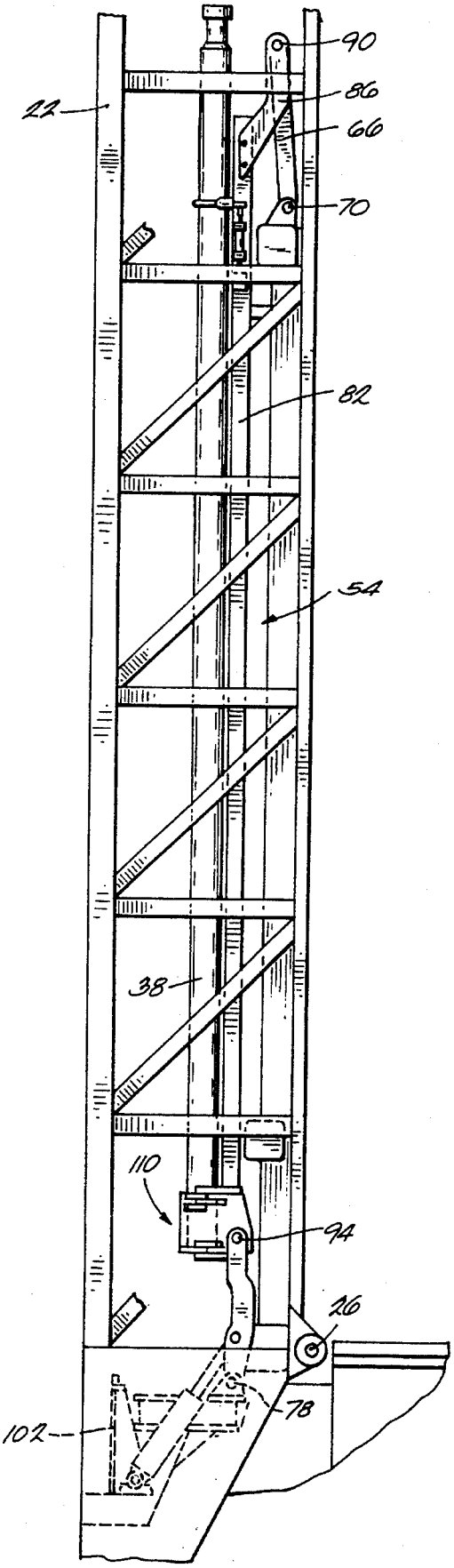
FIG. 3 is an enlarged, partial side elevational view of the mast.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A blasthole drill 10 embodying the invention is illustrated in FIG. 1. The blasthole drill 10 comprises a frame 14 supported by crawlers 18 for movement over the ground. A mast 22 is supported by the frame 14 for movement relative thereto about a generally horizontal axis 26 and between a substantially vertical position (shown in FIG. 1) and a number of angled or non-vertical positions (not shown). The mast 22 defines a drill hole axis 30. A rotary head 34 is moveable relative to the mast 22 along the drill hole axis 30. The rotary head 34 is selectively engageable with the upper end of a drill pipe 38 supported relative to the mast 22 (as described below). A pair of deck wrenches 42 (FIG. 2) are mounted on the bottom plate 46 of the mast 22. As is known in the art, the deck wrenches 42 selectively engage a drill pipe section to facilitate disconnection of two sections. The blasthole drill 10 as thus far described is conventional and will not be described in greater detail.

The blasthole drill 10 also comprises (see FIG. 2) four drill-through pipe racks 50, 54, 58 and 62. It should be understood that any number of pipe racks can be employed. The pipe racks 50, 54, 58 and 62 are selectively operable as described below to move drill pipe sections from a stored position to a position on the drill hole axis 30 or over the drill hole. The pipe racks are shown in their stored positions in FIG. 2. When the mast 22 is in its vertical position, each pipe rack moves in a vertical plane including the drill hole axis 30. The pipe racks 50, 54, 58 and 62 are substantially identical, and only the pipe rack 54 will be described in detail. Common elements have been given the same reference numerals.

Figure 5:
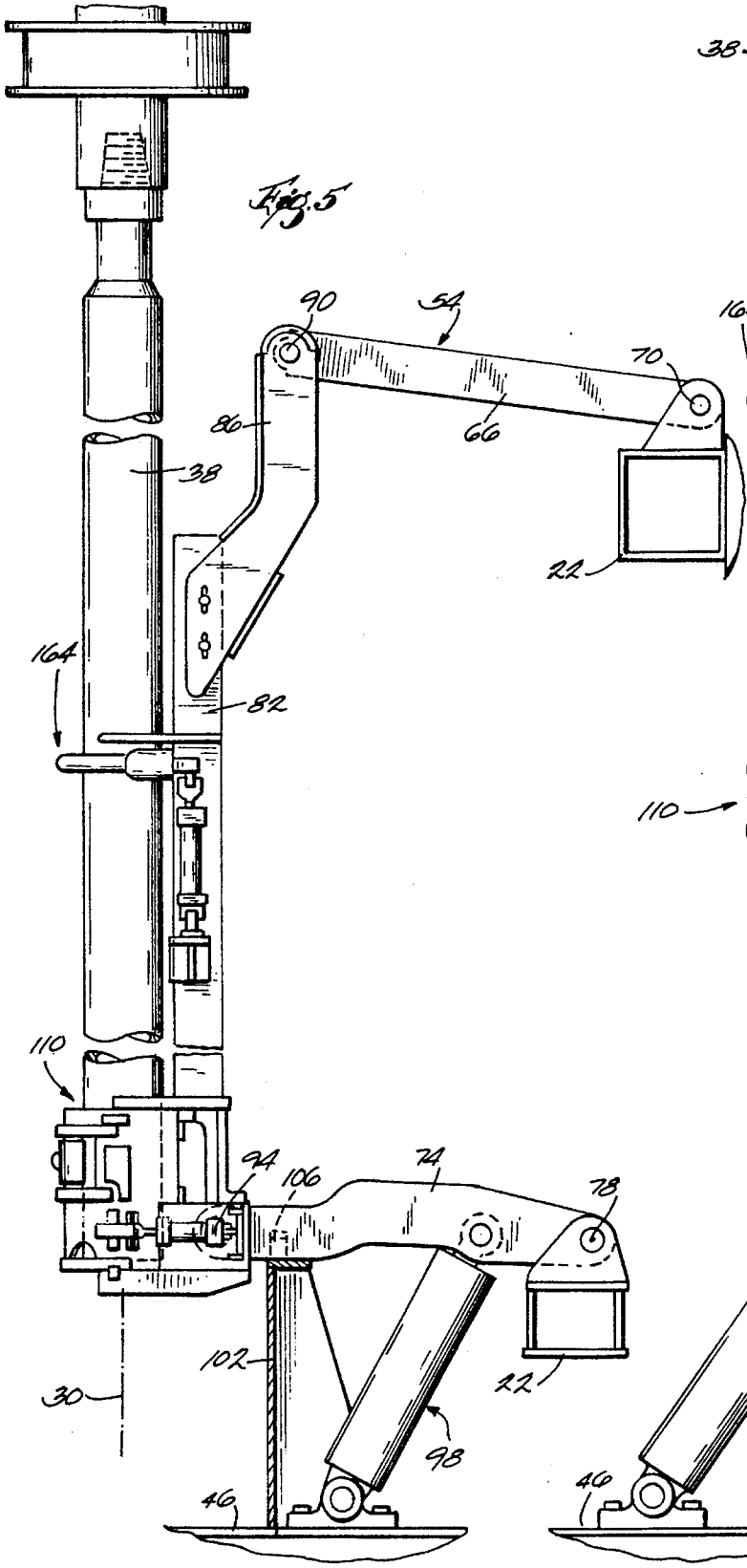
FIG. 5 is a view similar to FIG. 4 showing the pipe rack in its extended position.

The pipe rack 54 includes (see FIGS. 3–5) an upper arm 66 having inner and outer ends. The inner end is connected to the mast 22 for pivotal movement relative thereto about a generally horizontal axis 70. The upper arm 66 is moveable relative to the mast 22 between a generally vertical position (FIGS. 3 and 4) and a generally horizontal position (FIG. 5). The pipe rack 54 also includes a lower arm 74 having inner and outer ends. The inner end of the lower arm 74 is connected to the mast 22 for pivotal movement relative thereto about a generally horizontal axis 78. The lower arm 74 is moveable between a generally vertical position (FIGS. 3 and 4) and a generally horizontal position (FIG. 5).

Figure 4:
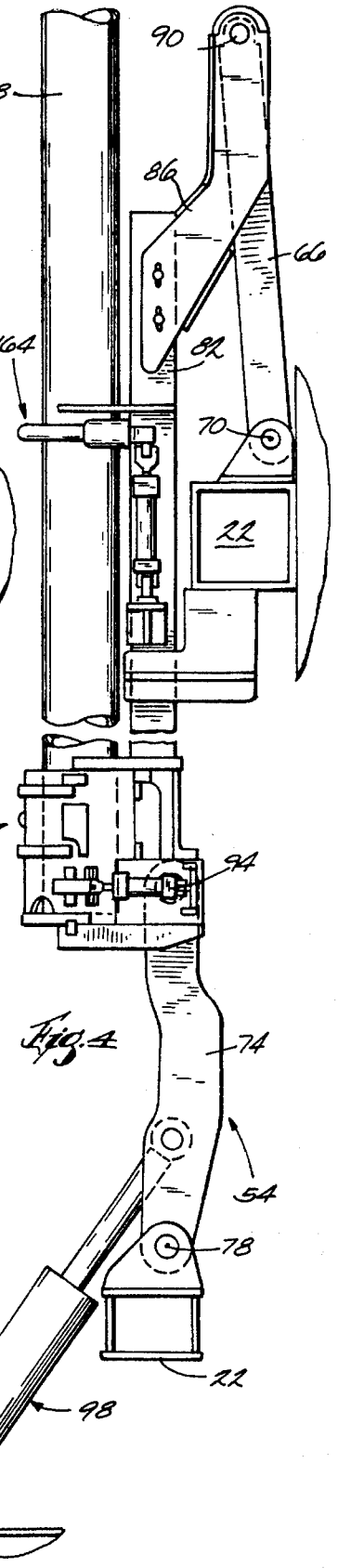
FIG. 4 is a side elevational view of the pipe rack with the rack member in its retracted position.

The pipe rack 54 also includes an elongated rack member 82 having upper and lower ends and having a longitudinal axis generally parallel to the drill hole axis 30. The upper end of the rack member 82 has thereon a clevis 86, and the outer end of the upper arm 66 is connected to the upper end of the clevis 86 for pivotal movement relative thereto about a generally horizontal axis 90. Thus, the outer end of the upper arm 66 is pivotally connected to the rack member 82. The lower end of the rack member 82 is connected to the outer end of the lower arm 74 for pivotal movement relative thereto about a generally horizontal axis 94. The mast 22, the upper and lower arms 66 and 74 and the rack member 82 define a parallelogram. As is apparent from FIGS. 4 and 5, pivotal movement of the lower arm 74 from its vertical position to its horizontal position moves the upper arm 66 from its vertical position to its horizontal position and moves the rack member 82 horizontally and downwardly while maintaining the rack member 82 generally parallel to the drill hole axis 30 (i.e., vertical when the mast 22 is vertical). The lower arm 74 is moved between its vertical and horizontal positions by a hydraulic assembly 98 connected between the lower arm 74 and the bottom plate 46 of the mast 22. The upper end of the hydraulic assembly 98 is pivotally connected to the lower arm 74, and the lower end of the hydraulic assembly 98 is pivotally connected to the mast 22. Accordingly, the hydraulic assembly 98 moves the rack member 82 relative to the mast 22 and between an extended position (FIG. 5) and a retracted position (FIG. 4). This movement is in a plane including the drill hole axis 30 and is horizontal when the mast 22 is vertical. Referring to FIG. 2, it can be seen that the pipe racks 50, 54, 58 and 62 are angularly spaced such that the respective rack members 82 move in angularly spaced planes including the drill hole axis 30.

A lower support 102 (FIGS. 2 and 5) is mounted on the mast bottom plate 46 and provides vertical and horizontal support for the lower arm 74 when the lower arm 74 is in its horizontal position. As best shown in FIG. 5, the lower support 102 includes a projection 106 which extends inside the lower arm 74 to provide horizontal support.

Figure 12:
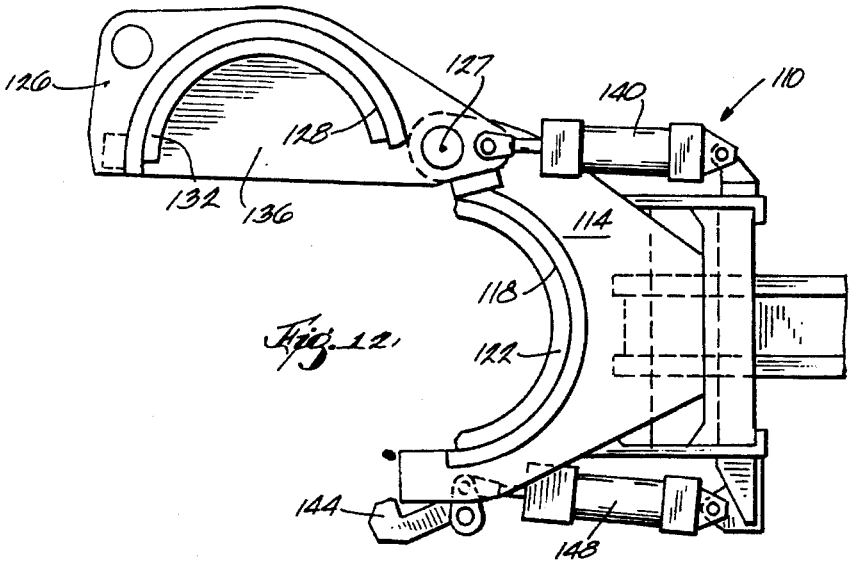
FIG. 12 is a view similar to FIG. 11 showing the lower gate opened.
Figure 11:
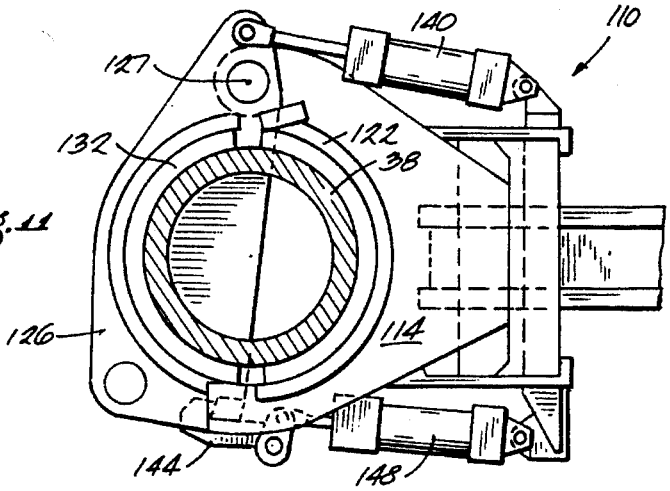
FIG. 11 is a top plan view of the portion of the pipe rack shown in FIG. 10.

The pipe rack 54 also includes (see FIGS. 5 and 10–13) a lower gate 110 mounted on the rack member 82 adjacent the lower end thereof. The lower gate 110 includes (see FIGS. 10–13) an inner gate portion 114 fixed relative to the rack member 82. The inner gate portion 114 has (see FIGS. 11 and 12) a generally semi-cylindrical inner surface 118. A semi-cylindrical insert 122 is mounted on the inner surface 118. The lower gate 110 also includes an outer gate portion 126 selectively moveable relative to the inner gate portion 114 about a generally vertical axis 127 and between open (FIG. 12) and closed (FIG. 11) positions. The outer gate portion 126 has a generally semi-cylindrical inner surface 128. A semi-cylindrical insert 132 is mounted on the inner surface. The inner surface of the inserts 122 and 132 define a generally cylindrical surface adapted to surround a drill pipe 38 (as shown in FIG. 11) when the outer gate portion 126 is in its closed position. The size of the inserts 122 and 132 can be varied to accommodate pipes of different sizes. The outer gate portion 126 also includes a generally horizontal shelf 136 (FIG. 12) which supports the lower end of a drill pipe 38 when the outer gate portion 126 is in its closed position. When the outer gate portion 126 moves to its open position, the shelf 136 moves out from beneath the drill pipe 38 such that the drill pipe 38 can move downwardly relative to the lower gate 110. If the mast 22 is angled, the drill pipe 38 continues to be supported by the inner gate portion 114 so that the inner gate portion 114 maintains the drill pipe 38 on the drill hole axis 30. Also, when the outer gate portion 126 is in its open position, the outer gate portion 126 is positioned to allow movement of the lower gate 110 away from a drill pipe 38 previously supported by the lower gate 110.

The outer gate portion 126 is moved between its open and closed positions by a hydraulic assembly 140 extending between the inner gate portion 114 and the outer gate portion 126. A latch 144 pivotally mounted on the inner gate portion 114 is moveable between latching (FIG. 11) and non-latching (FIG. 12) positions. The latch 144 secures the outer gate portion 126 in its closed position when the latch 144 is in its latching position. A second hydraulic assembly 148 extending between the latch 144 and the inner gate portion 114 moves the latch 144 and secures the latch 144 in its latching position when the outer gate portion 126 is in its closed position. The hydraulic assemblies 140 and 148 are operably connected such that the hydraulic assembly 148 will not allow the latch 144 to move from its latching position unless the hydraulic assembly 140 is actuated to move the outer gate portion 126 from its closed position. This prevents accidental opening of the lower gate 110.

The lower gate 110 also includes a pawl mechanism for engaging a drill pipe 38 to prevent rotation of the drill pipe 38 in one direction when the outer gate portion 126 is in its closed position. The pawl mechanism includes (see FIG. 13) a pawl 152 pivotally mounted on the inner gate portion 114 and a pawl 156 pivotally mounted on the outer gate portion 126. The pawls are biased inwardly by springs 160.

Figure 7:
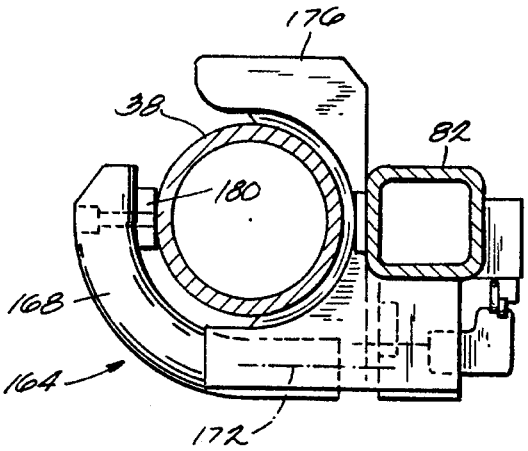
FIG. 7 is a top plan view of the portion of the pipe rack shown in FIG. 6.
Figure 9:
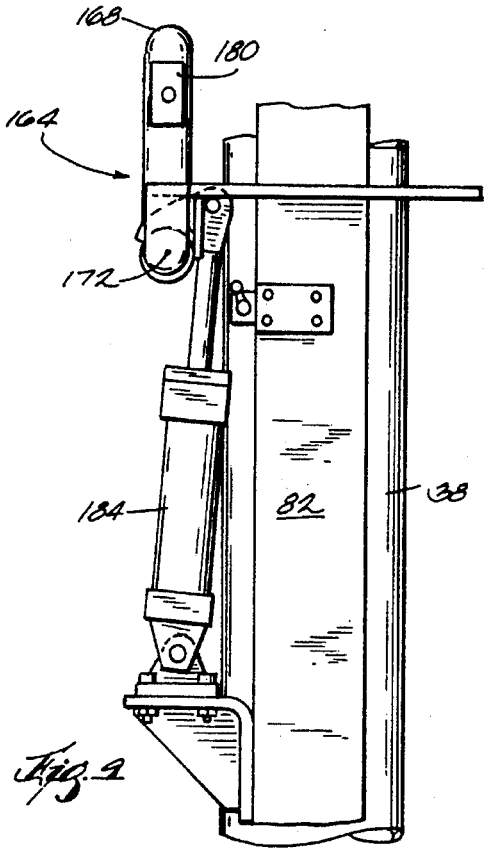
FIG. 9 is a view similar to FIG. 8 showing the upper gate opened.
Figure 6:
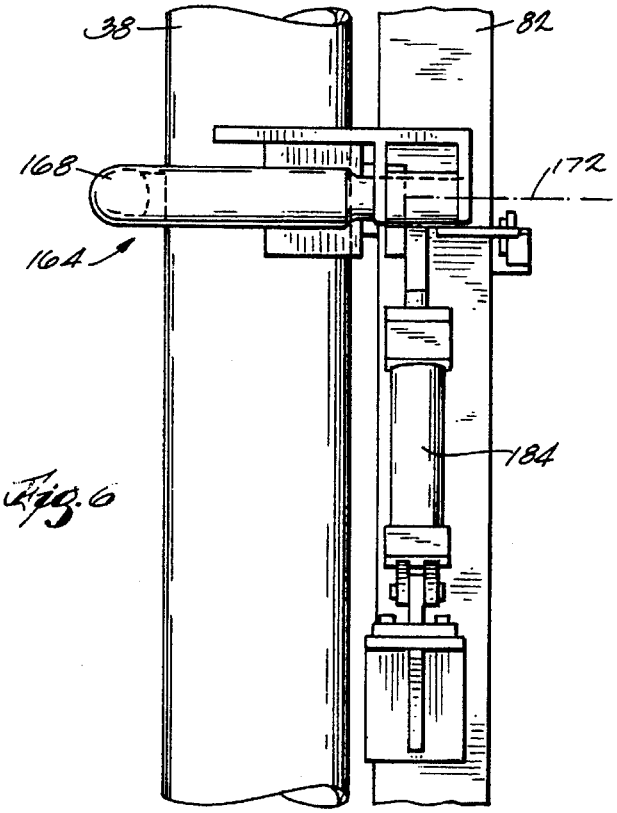
FIG. 6 is an enlarged portion of FIG. 5.
Figure 8:
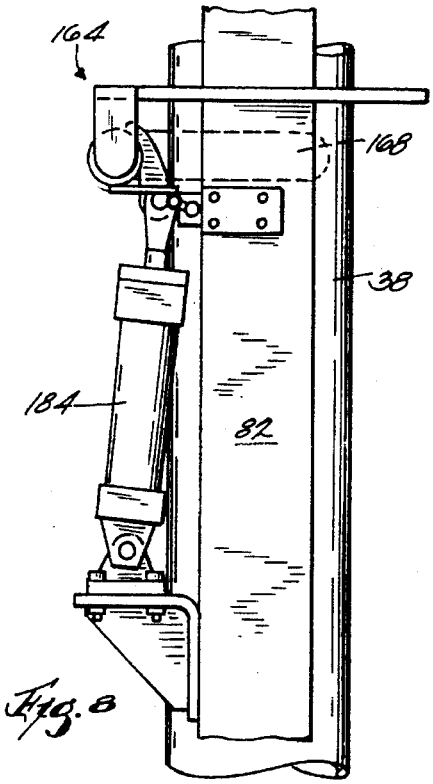
FIG. 8 is a right side elevational view of the portion of the pipe rack shown in FIG. 6.
Figure 10:
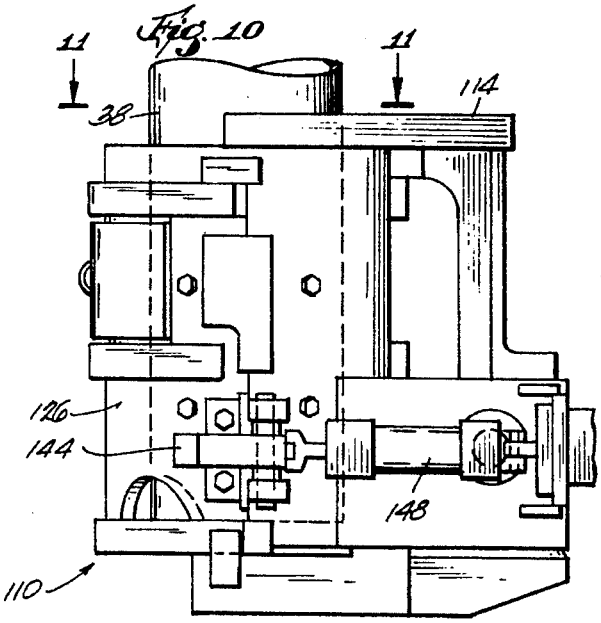
FIG. 10 is an enlarged portion of FIG. 5.
Figure 13:
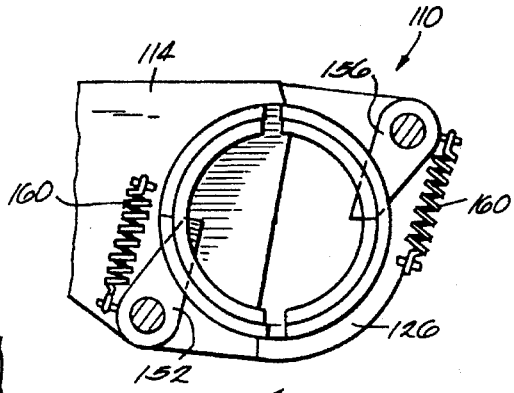
FIG. 13 is a horizontal sectional view of the lower gate showing the pawls for engaging a drill pipe.

The pipe rack 54 also includes (see FIGS. 4–9) an upper gate 164 mounted on the rack member 82 adjacent the upper end thereof. The upper gate 164 includes (see FIGS. 6–9) an upper support arm 168 selectively moveable relative to the rack member 82 between an open position (FIG. 9) and a closed position (FIGS. 6–8). As best shown in FIG. 7, the upper support arm 168 is arcuate and is pivotable relative to the rack member 82 about a generally horizontal axis 172. The upper support arm 168 cooperates with a support member 176 (FIG. 7) extending from the rack member 82 to secure a drill pipe 38 relative to the rack member 82 when the upper support arm 168 is in its closed position. A block 180 on the arm engages the pipe 38. The size of the block 180 can be varied to accommodate pipes of different sizes. When the upper support arm 168 is in its open position, the upper support arm 168 allows movement of a drill pipe 38 away from the rack member 82. Conversely, the rack member 82 is moveable away from a drill pipe 38 previously supported by the upper gate 164 when the upper support arm 168 is in its open position. A hydraulic assembly 184 extending between the rack member 82 and the upper support arm 168 moves the upper support arm 168 between its open and closed positions.

To operate the pipe rack 54 with a bit and stabilizer (not shown) secured by the deck wrenches 42, the hydraulic assembly 98 is actuated to move the rack member 82 to its extended position (FIG. 5) in which the lower arm 74 rests on the support 102. With the rack member 82 over the drill hole, the rotary head 34 is lowered and screwed onto the top joint of the drill pipe 38. After this joint is made, the upper and lower gates are simultaneously opened by the hydraulic assemblies 140 and 184. After the gates are opened, the rotary head 34 and attached drill pipe 38 are lowered and the lower end of the drill pipe 38 is attached to the stabilizer held by the deck wrenches 42. With this joint connection complete, the deck wrenches 42 retract and the rotary head 34 and drill pipe 38 can be further lowered. The rotary head 34 can continue to move downwardly until the rotary head 34 reaches the top of the pipe rack 54. In other words, it is not necessary to retract the rack member 82 until the rotary head 34 reaches the top of the pipe rack 54. Consequently, if the drill pipe 38 is taller than the pipe rack 54, as illustrated in FIG. 5, drilling can begin before the pipe rack 54 is retracted. This saves a great amount of time because the operator does not have to wait for the pipe rack 54 to clear the pipe 38 before beginning drilling. It should be understood that the drill pipe 38 can be two times as tall as the pipe rack 54 or rack member 82. The upper end of the pipe 38 preferably rests against a support (not shown) on the mast 22 when the rack member 82 is retracted.

The pipe rack 54 can be retracted anytime after the drill pipe 38 is connected to the stabilizer. As the rack clears the drill pipe 38, the upper and lower gates are closed. Once the gates are closed a limit switch (not shown) trips and activates a light (not shown) in the operator's cab indicating that the gates are closed. Also, a limit switch (not shown) in the mast 22 trips and signals the operator when the pipe 38 is stored and secured.

To remove the drill pipe 38, the lower joint connection is brought up to the deck and secured with the deck wrenches 42. The pipe rack 54 is extended with the gates opened. Next, the lower joint is broken loose with the rotary head 34, and then the rotary head 34 is raised until the bottom of the drill pipe 38 is slightly above the shelf 136 of the lower gate 110. The gates are then closed. When the lower gate 110 closes, the pipe flutes (not shown) are in position with the pawls 152 and 156 to break the joint loose from the rotary head 34. After the rotary head 34 is disconnected from the top of the pipe, the rotary head 34 is raised enough to clear the drill pipe 38 for retracting the pipe rack 54 to the stored position. Once the pipe rack 54 is stored, a limit switch trips and a light in the operator's cab indicates that the rack is secured.

Various features of the invention are set forth in the following claims.

I claim:

1. A blasthole drill comprising a frame supported for movement over the ground, a mast supported by said frame for movement relative thereto between a substantially vertical position and a non-vertical position, said mast defining a drill hole axis, a drill-through pipe rack mounted on said mast, said pipe rack including an upper arm having inner and outer ends, said inner end being connected to said mast for pivotal movement relative thereto, a lower arm having inner and outer ends, said inner end of said lower arm being connected to said mast for pivotal movement relative thereto about a generally horizontal inner axis, a rack member having upper and lower ends and a longitudinal axis generally parallel to said drill hole axis, said upper end of said rack member being connected to said outer end of said upper arm for relative pivotal movement and said lower end of said rack member being connected to said outer end of said lower arm for relative pivotal movement about a generally horizontal outer axis, and a gate mounted on said rack member, said gate having open and closed modes and being adapted to support the lower end of a drill pipe when said gate is in said closed mode, said upper and lower arms, said rack member and said mast defining a parallelogram structure such that said rack member is movable horizontally relative to said mast and between an extended position wherein a drill pipe supported by said gate is on said drill hole axis and a retracted position wherein said gate is spaced from a drill pipe on said drill hole axis, said gate permitting the drill pipe to move downwardly relative to said gate when said gate switches to said open mode and while said rack member is in said extended position, and said gate allowing movement of said rack member away from a drill pipe previously supported by said gate when said gate is in said open mode, a mechanism for moving said upper and lower arms and said rack member so as to move said rack member between said extended and retracted positions, said lower arm extending generally horizontally when said rack member is in said extended position and said mast is in said vertical position and extending generally vertically when said rack member is in said retracted position and said mast is in said vertical position such that, when said mast is in said vertical position and said rack member moves from said extended position to said retracted position, said outer axis moves through a vertical plane including said inner axis, a lower arm support which is mounted on said mast and which provides vertical and horizontal support for said lower arm when said rack member is in said extended position, said lower arm support including an upwardly facing surface that engages said lower arm when said rack member is in said extended position to provide vertical support for said lower arm, and including at least one generally vertical surface that engages said lower arm when said rack member is in said extended position to provide horizontal support for said lower arm, and a rotary head moveable relative to said mast along said drill hole axis, said rotary head being selectively engageable with the upper end of a drill pipe supported by said pipe rack when said rack member is in said extended position.

2. A blasthole drill as set forth in claim 1 wherein said mechanism for moving said rack member includes a hydraulic assembly having one end pivotally connected to said mast and having an opposite end pivotally connected to said lower arm such that extension and contraction of said hydraulic assembly moves said upper and lower arms so as to move said rack member between said extended and retracted positions.

3. A blasthole drill as set forth in claim 1 wherein said gate is mounted adjacent said lower end of said rack member, and wherein said drill also comprises an upper gate mounted on said rack member adjacent said upper end thereof, said upper gate including an upper support arm selectively moveable relative to said rack member between an open position and a closed position, said upper support arm being positioned to secure a drill pipe relative to said rack member when said upper support arm is in said closed position and being positioned to allow movement of a drill pipe away from said rack member when said upper support arm is in said open position.

4. A blasthole drill as set forth in claim 3 wherein said upper gate also includes a hydraulic assembly for moving said upper support arm between said open and closed positions.

5. A blasthole drill as set forth in claim 1 wherein said gate maintains the position of the drill pipe on said drill hole axis during initial downward movement of the drill pipe in response to downward movement of said rotary head.

6. A blasthole drill as set forth in claim 1 wherein said gate includes an inner gate portion fixed relative to said rack member, and only one outer gate portion selectively moveable relative to said inner gate portion about a generally vertical axis and between open and closed positions, said outer gate portion being positioned to allow movement of said gate away from a drill pipe previously supported by said gate when said outer gate portion is in said open position.

7. A blasthole drill as set forth in claim 6 wherein said gate also includes a first hydraulic assembly for moving said outer gate portion between said open and closed positions, a latch movable between latching and non-latching positions, said latch securing said outer gate portion in said closed position when said latch is in said latching position, and a second hydraulic assembly for securing said latch in said latching position when said outer gate portion is in said closed position.

8. A blasthole drill as set forth in claim 6 wherein said gate also includes a pawl mechanism for engaging a drill pipe to prevent rotation of the drill pipe in one direction when said outer gate portion is in said closed position.

9. A blasthole drill as set forth in claim 6 wherein said inner gate portion has a generally semi-cylindrical inner surface adapted to engage a drill pipe, and said outer gate portion has a generally semi-cylindrical inner surface adapted to engage a drill pipe, said inner surfaces of said inner and outer gate portions defining a generally cylindrical surface adapted to surround a drill pipe when said outer gate portion is in said closed position.

10. A blasthole drill as set forth in claim 6 wherein said outer gate portion also includes a generally horizontal shelf adapted to support the lower end of a drill pipe when said outer gate portion is in said closed position, said shelf moving out from beneath the drill pipe when said outer gate portion moves to said open position such that the drill pipe can move downwardly relative to said lower gate.

11. A blasthole drill as set forth in claim 6 wherein said outer gate portion pivots relative to said inner gate portion about an axis generally parallel to said drill hole axis.

12. A blasthole drill comprising a frame supported for movement over the ground, a mast supported by said frame for movement relative thereto between a substantially vertical position and a non-vertical position, said mast defining a drill hole axis, a drill-through pipe rack mounted on said mast, said pipe rack including an upper arm having inner and outer ends, said inner end being connected to said mast for pivotal movement relative thereto about a generally horizontal axis and between a generally vertical position and a generally horizontal position when said mast is in said vertical position, a lower arm having inner and outer ends, said inner end of said lower arm being connected to said mast for pivotal movement relative thereto about a generally horizontal inner axis and between a generally vertical position and a generally horizontal position when said mast is in said vertical position, a rack member having upper and lower ends and having a longitudinal axis generally parallel to said drill hole axis, said upper end of said rack member being connected to said outer end of said upper arm for relative pivotal movement about a generally horizontal axis, and said lower end of said rack member being connected to said outer end of said lower arm for relative pivotal movement about a generally horizontal outer axis, an upper gate mounted on said rack member adjacent said upper end thereof, said upper gate including an upper support arm selectively moveable relative to said rack member between an open position and a closed position, said upper support arm being positioned to secure a drill pipe relative to said rack member when said upper support arm is in said closed position and being positioned to allow movement of a drill pipe away from said rack member when said upper support arm is in said open position, and said upper gate also including a hydraulic assembly for moving said upper support arm between said open and closed positions, a lower gate mounted on said rack member adjacent said lower end thereof, said lower gate including an inner gate portion fixed relative to said rack member, said inner gate portion having a generally semi-cylindrical inner surface adapted to engage a drill pipe, said lower gate also including only one outer gate portion selectively moveable relative to said inner gate portion about an axis generally parallel to said drill hole axis and between open and closed positions, said outer gate portion having a generally semi-cylindrical inner surface adapted to engage a drill pipe, said inner surfaces of said inner and outer gate portions defining a generally cylindrical surface adapted to surround a drill pipe when said outer gate portion is in said closed position, said outer gate portion also including a generally horizontal shelf adapted to support the lower end of a drill pipe when said outer gate portion is in said closed position, said shelf moving out from beneath the drill pipe when said outer gate portion moves to said open position such that the drill pipe can move downwardly relative to said lower gate, and said outer gate portion being positioned to allow movement of said lower gate away from a drill pipe previously supported by said lower gate when said outer gate portion is in said open position, and said lower gate also including a first hydraulic assembly for moving said outer gate portion between said open and closed positions, a latch movable between latching and non-latching positions, said latch securing said outer gate portion in said closed position when said latch is in said latching position, a second hydraulic assembly for securing said latch in said latching position when said outer gate portion is in said closed position, and a pawl mechanism for engaging a drill pipe to prevent rotation of the drill pipe in one direction when said outer gate portion is in said closed position, a mechanism for moving said rack member horizontally relative to said mast and between an extended position wherein said lower gate is on said drill hole axis and a retracted position wherein said lower gate is spaced from said drill hole axis, said mechanism including a hydraulic assembly having one end pivotally connected to said mast and having an opposite end pivotally connected to said lower arm such that extension and contraction of said hydraulic assembly moves said upper and lower arms between the respective horizontal and vertical positions so as to move said rack member between said extended and retracted positions, and such that, when said mast is in said vertical position and said rack member moves from said extended position to said retracted position, said outer axis moves through a vertical plane including said inner axis, and a lower arm support which is mounted on said mast and which provides vertical and horizontal support for said lower arm when said lower arm is in said horizontal position, said lower arm support including an upwardly facing surface that engages said lower arm when said rack member is in said extended position to provide vertical support for said lower arm, and including at least one generally vertical surface that engages said lower arm when said rack member is in said extended position to provide horizontal support for said lower arm, and a rotary head moveable relative to said mast along said drill hole axis, said rotary head being selectively engageable with the upper end of a drill pipe supported by said pipe rack when said rack member is in said extended position, such that the drill pipe rotates with said rotary head and can move downwardly with said rotary head after said outer gate portion moves to said open position.

13. A blasthole drill as set forth in claim 12 wherein said inner gate portion maintains the position of the drill pipe on said drill hole axis during initial downward movement of the drill pipe in response to downward movement of said rotary head.

14. A blasthole drill comprising a frame supported for movement over the ground, a mast supported by said frame for movement relative thereto between a substantially vertical position and a non-vertical position, said mast defining a drill hole axis, a drill-through pipe rack mounted on said mast, said pipe rack including an upper arm having inner and outer ends, said inner end being connected to said mast for pivotal movement relative thereto, a lower arm having inner and outer ends, said inner end of said lower arm being connected to said mast for pivotal movement relative thereto, a rack member having upper and lower ends and a longitudinal axis generally parallel to said drill hole axis, said upper end of said rack member being connected to said outer end of said upper arm for relative pivotal movement and said lower end of said rack member being connected to said outer end of said lower arm for relative pivotal movement, and a gate mounted on said rack member, said gate having open and closed modes and being adapted to support the lower end of a drill pipe when said gate is in said closed mode, said upper and lower arms, said rack member and said mast defining a parallelogram structure such that said rack member is movable horizontally relative to said mast and between an extended position wherein a drill pipe supported by said gate is on said drill hole axis and a retracted position wherein said gate is spaced from a drill pipe on said drill hole axis, said gate permitting the drill pipe to move downwardly relative to said gate when said gate switches to said open mode and while said rack member is in said extended position, and said gate allowing movement of said rack member away from a drill pipe previously supported by said gate when said gate is in said open mode, a mechanism for moving said upper and lower arms and said rack member so as to move said rack member between said extended and retracted positions, a lower arm support which is mounted on said mast and which provides vertical and horizontal support for said lower arm when said rack member is in said extended position, said lower arm support including an upwardly facing surface that engages said lower arm when said rack member is in said extended position to provide vertical support for said lower arm, and including at least one generally vertical surface that engages said lower arm when said rack member is in said extended position to provide horizontal support for said lower arm, and a rotary head moveable relative to said mast along said drill hole axis, said rotary head being selectively engageable with the upper end of a drill pipe supported by said pipe rack when said rack member is in said extended position.

15. A blasthole drill comprising a frame supported for movement over the ground, a mast supported by said frame for movement relative thereto between a substantially vertical position and a non-vertical position, said mast defining a drill hole axis, a drill-through pipe racks mounted on said mast, said pipe racks including an upper arm having inner and outer ends, said inner end being connected to said mast for pivotal movement relative thereto, a lower arm having inner and outer ends, said inner end of said lower arm being connected to said mast for pivotal movement relative thereto about a generally horizontal inner axis, a rack member having upper and lower ends and a longitudinal axis generally parallel to said drill hole axis, said upper end of said rack member being connected to said outer end of said upper arm for relative pivotal movement and said lower end of said rack member being connected to said outer end of said lower arm for relative pivotal movement about a generally horizontal outer axis, and a gate mounted on said rack member, said gate having open and closed modes and being adapted to support the lower end of a drill pipe when said gate is in said closed mode, said upper and lower arms, said rack member and said mast defining a parallelogram structure such that said rack member is movable horizontally relative to said mast and between an extended position wherein a drill pipe supported by said gate is on said drill hole axis and a retracted position wherein said gate is spaced from a drill pipe on said drill hole axis, said gate permitting the drill pipe to move downwardly relative to said gate when said gate switches to said open mode and while said rack member is in said extended position, and said gate allowing movement of said rack member away from a drill pipe previously supported by said gate when said gate is in said open mode, a mechanism for moving said upper and lower arms and said rack member so as to move said rack member between said extended and retracted positions, said lower arm extending generally horizontally when said rack member is in said extended position and said mast is in said vertical position and extending generally vertically when said rack member is in said retracted position and said mast is in said vertical position such that, when said mast is in said vertical position and said rack member moves from said extended position to said retracted position, said outer axis moves through a vertical plane including said inner axis, and a rotary head moveable relative to said mast along said drill hole axis, said rotary head being selectively engageable with the upper end of a drill pipe supported by said pipe rack when said rack member is in said extended position.

16. A blasthole drill as set forth in claim 15 wherein said mechanism for moving said rack member includes a hydraulic assembly having one end pivotally connected to said mast and having an opposite end pivotally connected to said lower arm such that extension and contraction of said hydraulic assembly moves said upper and lower arms so as to move said rack member between said extended and retracted positions.

17. A blasthole drill as set forth in claim 16 and further comprising a lower arm support which is mounted on said mast and which provides vertical and horizontal support for said lower arm when said rack member is in said extended position.

* * * * *